US010344703B2

(12) United States Patent
Nieddu et al.

(10) Patent No.: US 10,344,703 B2
(45) Date of Patent: Jul. 9, 2019

(54) INJECTOR DELIVERY MEASUREMENT WITH LEAKAGE CORRECTION

(71) Applicant: GM GLOBAL TECHNOLOGY OPERATIONS LLC, Detroit, MI (US)

(72) Inventors: Stefano Nieddu, Turin (IT); Andrea Mollar, La Loggia (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 111 days.

(21) Appl. No.: 15/638,026

(22) Filed: Jun. 29, 2017

(65) Prior Publication Data

US 2019/0003414 A1 Jan. 3, 2019

(51) Int. Cl.

| | |
|---|---|
| ***F02D 41/38*** | (2006.01) |
| ***F02M 26/47*** | (2016.01) |
| ***F02D 1/06*** | (2006.01) |
| ***F02D 41/24*** | (2006.01) |
| *F02D 41/28* | (2006.01) |
| *F02D 41/14* | (2006.01) |

(52) U.S. Cl.

CPC ..... *F02D 41/3872* (2013.01); *F02D 1/06* (2013.01); *F02D 41/2467* (2013.01); *F02M 26/47* (2016.02); *F02D 41/3809* (2013.01); *F02D 41/3818* (2013.01); *F02D 41/3827* (2013.01); *F02D 2041/1432* (2013.01); *F02D 2041/286* (2013.01); *F02D 2200/0602* (2013.01); *F02D 2200/0612* (2013.01); *F02D 2200/0614* (2013.01); *F02D 2200/0616* (2013.01); *F02D 2250/14* (2013.01)

(58) Field of Classification Search

CPC ..... F02D 2200/0602; F02D 2200/0604; F02D 2200/0614; F02D 2200/0616

USPC ..... 73/114.48, 114.51

See application file for complete search history.

(56) References Cited

U.S. PATENT DOCUMENTS 6,349,702 B1 * 2/2002 Nishiyama ..... F02D 41/3836 123/447
6,353,791 B1 * 3/2002 Tuken ..... F02D 35/023 123/447
6,557,530 B1 * 5/2003 Benson ..... F02D 41/22 123/447

(Continued)

FOREIGN PATENT DOCUMENTS

GB 2487216 A * 7/2012 ..... F02D 41/2432

*Primary Examiner* — Sizo B Vilakazi
*Assistant Examiner* — Kevin R Steckbauer
(74) *Attorney, Agent, or Firm* — Lorenz & Kopf LLP

(57) ABSTRACT

A method for operating a combustion engine is provided. A fuel injector is operated to perform a fuel injection, a sequence of pressure signals of the fuel rail pressure during the fuel injection is sampled and filtered and a total pressure difference between a first sample after a top dead center of the fuel pump and before the fuel injection has started and a chosen second sample after the injection and before a next pumping stroke is determined. A linear pressure slope at the second sample and a leakage pressure difference between the first sample and the second sample based on the linear pressure slope is calculated, leading to calculating an injection pressure difference as the difference between total pressure difference and the leakage pressure difference. With this, a value of a fuel quantity injected as a function of the injection pressure difference can be determined, while leakages are compensated.

15 Claims, 3 Drawing Sheets

(56) References Cited

U.S. PATENT DOCUMENTS

| | | | | |
|---|---|---|---|---|
| 6,823,834 | B2 * | 11/2004 | Benson | F02D 41/22 123/299 |
| 6,990,855 | B2 * | 1/2006 | Tuken | F02D 41/2496 73/114.38 |
| 7,210,459 | B2 * | 5/2007 | Shibata | F02D 41/2467 123/456 |
| 7,523,743 | B1 * | 4/2009 | Geveci | F02D 41/3863 123/456 |
| 7,558,665 | B1 * | 7/2009 | Geveci | F02D 41/2438 123/447 |
| 7,788,015 | B2 * | 8/2010 | Geveci | F02D 41/0087 123/456 |
| 9,470,172 | B2 * | 10/2016 | Katsura | F02D 41/3809 |
| 2004/0011325 | A1 * | 1/2004 | Benson | F02D 41/22 123/299 |
| 2005/0235964 | A1 * | 10/2005 | Shibata | F02D 41/2467 123/458 |
| 2010/0222988 | A1 * | 9/2010 | Thomas | F02D 41/2438 701/103 |
| 2014/0216409 | A1 * | 8/2014 | Katsura | F02D 41/3809 123/456 |
| 2016/0215708 | A1 | 7/2016 | Nieddu et al. | |
| 2017/0350341 | A1 * | 12/2017 | Courtiel | F02D 41/062 |
| 2018/0017010 | A1 * | 1/2018 | Nieddu | F02D 41/3872 |

* cited by examiner

INJECTOR DELIVERY MEASUREMENT WITH LEAKAGE CORRECTION

TECHNICAL FIELD

The present disclosure generally relates to a method of operating an internal combustion engine of a motor vehicle, such as a Diesel engine or a Gasoline engine, and more particularly relates to a method of determining the fuel quantity of fuel injection by an engine fuel injector into a combustion chamber.

BACKGROUND

This section provides background information related to the present disclosure which is not necessarily prior art.

Modern combustion engines, e.g. of a motor vehicle, often include a fuel injection system having a fuel pump that delivers fuel at a high pressure to a fuel rail in fluid communication with a plurality of fuel injectors. Each of the fuel injectors corresponds to a combustion chamber of the engine and is designed for injecting metered quantities of fuel into the respective chamber. The injectors may be designed as solenoid valves. Often, the fuel injectors perform a plurality of injection pulses per engine cycle including a main injection and at least one additional injection, depending on the design of the engine and the emission requirements.

For maintaining a required accuracy for the individual fuel injections, it is known to determine the timing and quantity of the fuel injections and to conduct corrections where required. For example, it is known to analyze the fuel rail pressure over time to determine significant fuel rail pressure changes, from which timing and quantity can be calculated. This is exemplarily described in US 2016/0215708 A1.

By using a suitable digital filter on an acquired rail pressure signal a fuel quantity may directly be calculated based on a difference of rail pressure levels before and after the respective injection event. However, possible static errors caused by fuel leakages on the rail, which may be caused by a pressure regulator and/or an injector, are neglected in such an approach.

Accordingly, it is desirable to provide a method for determining timing and quantity of fuel injections with a sufficient compensation of potential leakage effects in the fuel rail system. In addition, it is desirable to provide a system that is capable of conducting such a method in a combustion engine. Furthermore, other desirable features and characteristics of the present invention will become apparent from the subsequent detailed description and the appended claims, taken in conjunction with the accompanying drawings and the foregoing technical field and background.

SUMMARY

A method is provided for operating an internal combustion engine having a fuel rail in fluid communication with a fuel pump and a fuel injector. The internal combustion engine includes a fuel rail in fluid communication with a fuel pump and with a fuel injector. The fuel injector is operated to perform a fuel injection. A sequence of pressure signals representative of a fuel pressure within the fuel rail during the fuel injection is sampled in a crankshaft angular domain. The sequence of pressure signals is filtered so as to reduce signal noise. In an injection interval, a first sample is acquired after a top dead center of the fuel pump and before the fuel injection has started is determined. Further, a second sample is acquired after the injection and before a next pumping stroke is chosen, and a total pressure difference between the first sample and the second sample is calculated. The term sample, in the context of first sample, second sample and third sample, is intended to indicate a data reading from a signal sequence (e.g., pressure signal sequencess) at a particular moment or instant in time. In addition, a linear pressure slope at the second sample is determined and a leakage pressure difference between the first sample and the second sample based on the linear pressure slope is calculated. Still further, an injection pressure difference as the difference between total pressure difference and the leakage pressure difference is calculated and a value of a fuel quantity injected by the fuel injection as a function of the calculated value of the injection pressure difference is calculated. A fuel injection command may be sent to the fuel injectors based on the value of a fuel quantity calculated.

By this, an improved method for determining the injected fuel quantity is provided, which compensates for leakages. A leakage is considered to have a linear effect on the fuel rail pressure and may be present in a pressure regulator and/or fuel injectors. Due to the linear effect, the fuel rail pressure linearly decreases when a leakage occurs. Measuring the fuel rail pressure therefore always includes a superposition of the original pressure deviation due to the action of the fuel pump and the additional pressure deviation due to leakages. Determining the pressure slope in the second sample assesses the linear component of the pressure deviation after the injection has been conducted, thereby allowing to extrapolate the linear pressure drop over the whole injection cycle. The precision of the determination of the injected fuel quantity is clearly improved without having to measure additional pressure values or any leakage flows.

Sampling the pressure signal in the crankshaft angular domain allows the sequence of measured pressure values to be independent from the rotational speed of the engine, which facilitates the analysis of the fuel injection process over the measured pressure signals. The crankshaft angular domain is to be understood as a rotational position of the crankshaft and may be given in a radian format, such as in multiples of $2\cdot\pi$, which is a complete revolution, i.e. 360° of the crankshaft.

The filtering of the pressure signals provides a reduction of signal noise, which in turn facilitates the analysis of the pressure signals. The filter to be applied may be a low-pass filter for allowing a portion of the signals below a given frequency to pass through. Depending on the technology of the used filter, all other signals, i.e. those with frequencies higher than the given frequency, may be attenuated. In an advantageous embodiment, the filter may be a digital N-order SINC filter, which substantially removes all frequency components above the given frequency, without affecting lower frequencies. The given frequency may be tuned on a rail wave pressure dominant frequency and the bandwidth in the digital filter output as well as the response behavior may be influenced by the order N. For example, a first order ($SINC^1$), a third order ($SINC^3$) or a fifth order ($SINC^5$) filter may be used.

The calculation of the fuel quantity may be conducted using a function $Q_{inlet}=f(\Delta p_{inj})$, which provides a relation between the quantity and an injection pressure difference ($\Delta p_{inj}$). The actual function is known from US 2016/0215708 A1, which is commonly owned by Applicant of the present application and the disclosure of which is expressly incorporated by reference herein. Thus, further discussion of the function shall not be discussed in detail herein. A main aspect in using this function lies in providing an exact injection pressure difference, which is the difference between the total pressure difference and the leakage pressure difference ($\Delta p_{leak}$). The total pressure difference is the pressure difference just before the injection process starts, i.e. at the first sample, and after the injection has been accomplished, i.e. at the second sample: $p_A - p_B = \Delta p_{inj} + \Delta p_{leak}$, where $p_A$ is the pressure at the first sample, $p_B$ is the pressure at the second sample, $Api_{nj}$ is the injection pressure difference and $\Delta p_{leak}$ is the leakage pressure difference. Hence, the injection pressure difference and the leakage pressure difference are superposed along a certain angular range of the angular crankshaft domain. To eliminate the leakage pressure difference, the linear pressure slope at the second sample is determined and the linear leakage pressure drop over the angular range of interest, i.e. between the first sample and the second sample, is calculated.

In this context, it is to be noted that the method may preferably be conducted for one fuel injector at a time, for example when the engine is running under cut-off conditions.

To determine the leakage pressure slope different methods may be used. For example, a third sample after the injection and before a next pumping stroke may be acquired. The second sample and the third sample are spaced apart from each other. Determining the linear pressure slope may then include calculating the pressure difference between the second sample and the third sample and dividing it by the crankshaft angle difference between the second sample and the third sample. Hence, by using a simple slope formula, the pressure difference between the third sample and the second sample divided by the crankshaft angle difference gives the pressure drop per crankshaft angle. This is independent from the actual third sample when chosen appropriately, i.e. near the second sample, but sufficiently far away to have a clear pressure difference between these samples in case a leakage is present at all. Such a slope formula is $\Delta p_{leak} = (p_0 - p_B) * \Delta\theta / \Delta\gamma$, where $p_0$ is the pressure at the third sample, $\Delta\theta$ the crankshaft angle difference between the first sample and the second sample, and $\Delta\gamma$ is the crankshaft angle difference between the second sample and the third sample.

As an advantageous embodiment, the second sample and the third sample may be spaced apart about at least $0.05 \cdot \pi$ of the crankshaft angle, which corresponds to a rotation about 9°. Consequently, the second sample and third sample are quite close together, such that the pressure values at these samples may be clearly discerned.

Even further advantageously, the second sample and the third sample may be spaced apart about at least $0.1 \cdot \pi$ of the crankshaft angle, which corresponds to a rotation about 18°, and in particular about at least $0.2 \cdot \pi$ of the crankshaft angle, which corresponds to a rotation about 36°. Hence, the second sample and third sample still relatively close together, but the leakage induced pressure difference value between these samples is comparably large, such that the accuracy of the slope calculation is improved.

In a still further advantageous embodiment calculating the leakage pressure difference may include multiplying the linear pressure slope at the second sample by the angle difference between the first sample and the second sample.

Also, an internal combustion engine is provided, which includes a fuel pump in fluid communication with a fuel injector through a fuel rail, and an electronic control unit. The electronic control unit is configured to operate the fuel injector to perform a fuel injection, to sample a sequence of pressure signals representative of a fuel pressure within the fuel rail during the fuel injection in a crankshaft angular domain, to filter the sequence of pressure signals so as to reduce signal noise, in an injection interval to acquire a first sample after a top dead center of the fuel pump and before the fuel injection has started, to acquire a second sample after the injection and before a next pumping stroke, to calculate a total pressure difference between the first sample and the second sample, to determine a linear pressure slope at the second sample and calculate a leakage pressure difference between the first sample and the second sample based on the linear pressure slope, to calculate an injection pressure difference as the difference between total pressure difference and the leakage pressure difference and to calculate a value of a fuel quantity injected by the fuel injection as a function of the calculated value of the injection pressure difference. The electronic control unit is configured to send a fuel injection command to the fuel injectors based on the value of a fuel quantity calculated.

It is referred to the above explanation of the method, which are conducted by the electronic control unit of the internal combustion engine. It is to be understood that the electronic control unit is configured for receiving sensor signals in a way that allows a further processing. For this purpose, either the respective sensor, such as a fuel rail pressure sensor, or the electronic control unit must be able to convert an analog signal to a digital signal, representing the physical value of interest in a digital format.

In an advantageous embodiment of the engine, the electronic control unit is configured to choose a third sample after the injection and before a next pumping stroke. The second sample and the third sample are spaced apart from each other. The electronic control unit is further configured to determine the linear pressure slope then calculate the pressure difference between the second sample and the third sample and divide it by the crankshaft angle difference between the second sample and the third sample.

In another advantageous embodiment of the engine, the second sample and the third sample are spaced apart about at least $0.05 \cdot \pi$ of the crankshaft angle. Preferably, the second sample and the third sample may be spaced apart about at least $0.1 \cdot \pi$ and in particular at least $0.2 \cdot \pi$ of the crankshaft angle.

Advantageously, the electronic control unit may be configured to calculate the leakage pressure difference by multiplying the linear pressure slope at the second sample by the angle difference between the first sample and the second sample.

Filtering the sequence of pressure signals may include using a SINC filter. The electronic control unit may be connected to a certain filter or filter arrangement or the electronic control unit may include a filter circuiting the form of either a hardware filter or a software filter. As mentioned above, such a SINC filter may be tuned on a rail wave pressure dominant frequency, which depends on the detail design of the fuel rail and may be found through simulation or experimental analysis.

Lastly, a vehicle is provided, which has an internal combustion engine including a fuel pump in fluid communication with a fuel injector through a fuel rail, and an electronic control unit. The electronic control unit is configured to operate the fuel injector to perform a fuel injection, to sample a sequence of pressure signals representative of a fuel pressure within the fuel rail during the fuel injection in a crankshaft angular domain, to filter the sequence of pressure signals so as to reduce signal noise, in an injection interval to determine a first sample after a top dead center of the fuel pump and before the fuel injection has started, to choose a second sample after the injection and before a next pumping stroke, to calculate a total pressure difference between the first sample and the second sample, to determine a linear pressure slope at the second sample and calculate a leakage pressure difference between the first sample and the second sample based on the linear pressure slope, to calculate an injection pressure difference as the difference between total pressure difference and the leakage pressure difference and to calculate a value of a fuel quantity injected by the fuel injection as a function of the calculated value of the injection pressure difference. The electronic control unit is configured to send a fuel injection command to the fuel injectors based on the value of a fuel quantity calculated.

DESCRIPTION OF THE DRAWINGS

The exemplary embodiments will hereinafter be described in conjunction with the following drawing figures, wherein like numerals denote like elements.

DETAILED DESCRIPTION

The following detailed description is merely exemplary in nature and is not intended to limit the invention disclosed herein or the application and uses of the invention disclosed herein. Furthermore, there is no intention to be bound by any principle or theory, whether expressed or implied, presented in the preceding technical field, background, summary or the following detailed description, unless explicitly recited as claimed subject matter.

Figure 1:
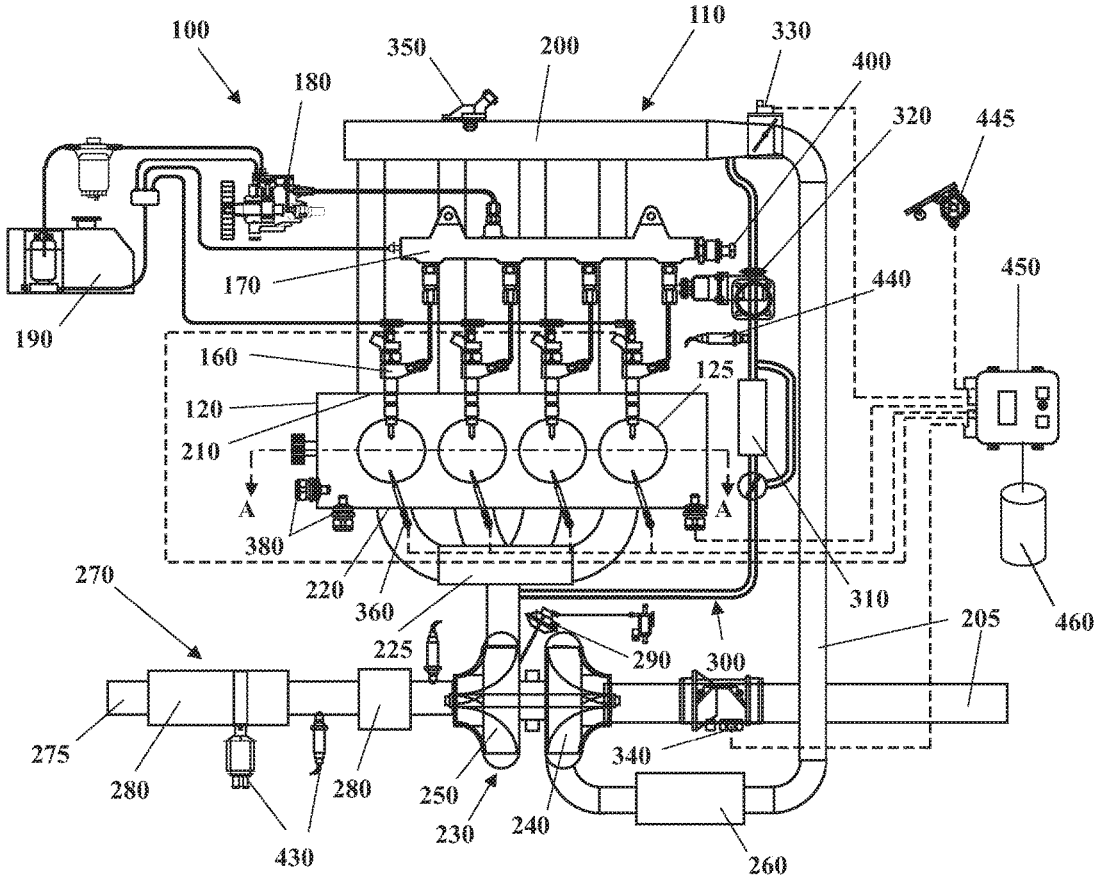
FIG. 1 schematically shows an automotive system in the form of internal combustion engine.
Figure 2:
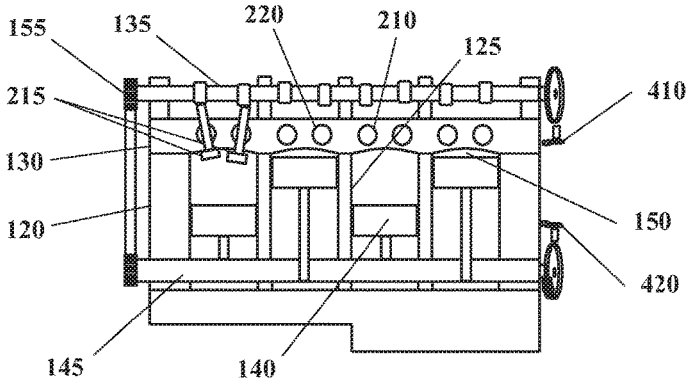
FIG. 2 is a sectional view (A-A) of the system shown in FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high-pressure fuel pump 180 that increase the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an aftertreatment system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The aftertreatment system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean $NO_x$ traps, hydrocarbon adsorbers, selective catalytic reduction (SCR) systems, and particulate filters, such as a Selective Catalytic Reduction on Filter (SCRF) 500. The SCRF 500 may be associated with a temperature sensor upstream of the SCRF 500 and temperature sensor downstream of the SCRF 560.

Other embodiments may include a high-pressure exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system, or data carrier 460, and an interface bus. The CPU is configured to execute instructions stored as a program in the memory system, and send and receive signals to/from the interface bus. The memory system may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carry out the steps of such methods and control the ICE 110.

The program stored in the memory system is transmitted from outside via a cable or in a wireless fashion. Outside the automotive system 100 it is normally visible as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a Wi-Fi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Besides other functions, the ECU 450 is configured to operate the fuel injectors 160 to inject fuel into the associated combustion chambers 150. Preferably, a fuel injector 160 may be realized in the form of an electromechanical valve having a nozzle in fluid communication with the associated combustion chamber 150, a needle and an electro-magnetic actuator, which moves the needle from a closed into an open position. The closed position may be maintained through a spring. Consequently, a cylinder 125 only receives fuel from the fuel rail 170 if the fuel injector 160 is in an open state, i.e. if the electro-magnetic actuator is energized. The quantity of the fuel depends on the duration of the open state. This fuel injection may be referred to as the "injection pulse", which is controlled and monitored through the ECU 450

During normal operation of the combustion engine 110, the ECU 450 operates the fuel injectors 160 to conduct the fuel injections as required for each engine cycle, which fuel injections may include a single injection pulse or a plurality of injection pulses for each combustion chamber 150. Operating the fuel injectors 160 includes energizing the respective electro-magnetic actuator at the right time and for a desired period. While the fuel quantity is an important parameter, also a correct injection timing is required. In particular, the correct timing of the injection pulses depends on an angular position of the engine crankshaft 145. A desired starting point for the injection (SOI) may be in a period when the crankshaft 145 passes through top dead center (TDC), i.e. just before TDC and just after TDC.

The fuel quantity of an injection pulse itself depends on the pressure in the fuel rail, a flow resistance and other flow influencing parameters between the fuel rail 170 and the combustion chamber 150 through the injector 160, and the energizing time (ET) for the respective fuel injector 160. The flow resistance depends on the type of fuel injector 160 and its momentary state that is controlled by the ECU 450. The energizing time is directly influenced by the ECU 450 through timing the activation and deactivation of the respective fuel injector 160, e.g. by selectively energizing its electromagnetic actuator. Hence, the ECU 450 is able to provide a desired injection fuel quantity for each injection pulse and each combustion chamber 150 by adjusting the energizing time and controlling the fuel injectors 160 depending on the actual requirement for the engine 110. The required energizing time may be calculated under consideration of the momentary fuel rail pressure as well as the respective parameters of the fuel injectors 160.

As explained above, the actual fuel quantity injected by the fuel injector 160 may not only differ from a desired quantity due to aging and/or production spread of the fuel injector 160, but also from a leakage effect. In order to always maintain the desired fuel quantities, the ECU 450 may be configured to perform a method for determining the correct timing and the correct fuel quantity, thereby adjusting the timing. For this purpose, the ECU 450 may be configured to execute a method as explained above.

Instead of an ECU 450, the automotive system 100 may have a different type of processor to provide the electronic logic, e.g. an embedded controller, an onboard computer, or any processing module that might be deployed in the vehicle and operable to execute computer program code for carrying out the method described above.

Figure 3:
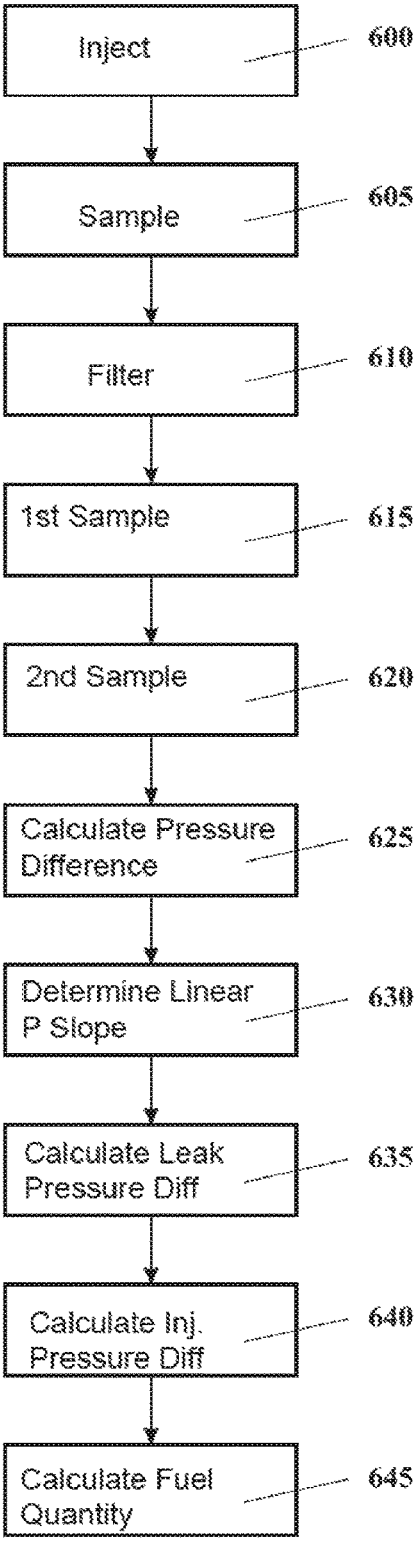
FIG. 3 shows a method in form a schematic flowchart.

FIG. 3 shows a flowchart of a method of operating the internal combustion engine 110. Here, the fuel injector 160 is operated (block 600) for a certain period of time by energizing the fuel injector 160, such that a single or a plurality of fuel injections is accomplished. A sequence of pressure signals representative of a fuel pressure within the fuel rail 170 during the fuel injection is sampled in a crankshaft angular domain (block 605). The fuel rail pressure may be acquired by the fuel rail pressure sensor 400. To reduce signal noises and facilitating the analysis of the sampled pressure signals, the sequence of pressure signals is filtered (block 610). In the method, a first sample after a top dead center of the fuel pump and before the fuel injection has started is determined (block 615) and a second sample after the injection and before a next pumping stroke is chosen (block 620). The total pressure difference between the first sample and the second sample is calculated (block 625), a linear pressure slope at the second sample is determined (block 630) and a leakage pressure difference between the first sample and the second sample based on the linear pressure slope is calculated (block 635). The injection pressure difference is calculated as the difference between total pressure difference and the leakage pressure difference (block 640) and a value of a fuel quantity injected by the fuel injection as a function of the calculated value of the injection pressure difference (block 645). A fuel injection command may be sent to the fuel injectors based on the value of a fuel quantity calculated.

Figure 4:
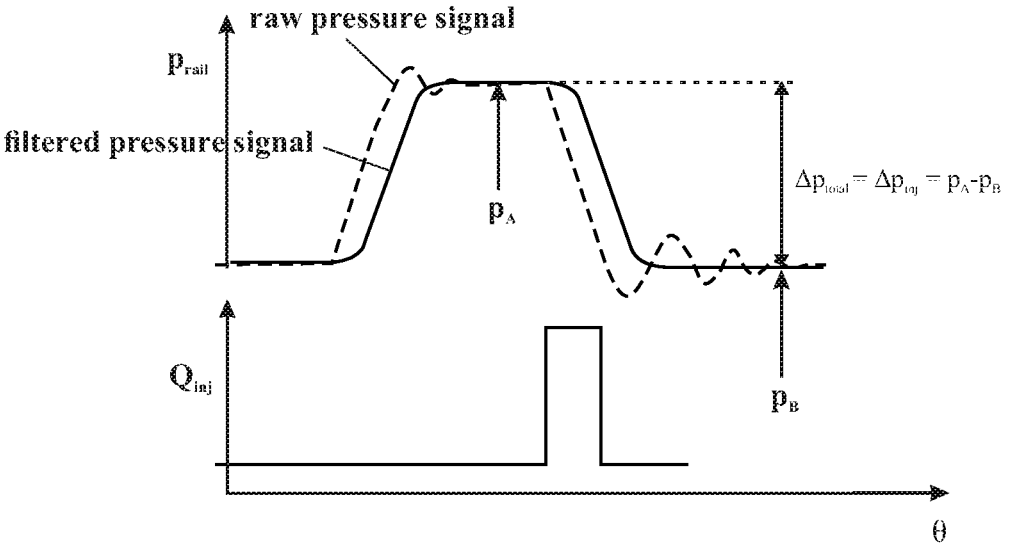
FIG. 4 shows pressure and fuel flow graphs without leakage.

FIG. 4 shows a sequence of pressure signals in a fuel rail 170 over the crankshaft angle $\theta$ in a certain crankshaft angle interval, which may exemplarily be 360°, i.e. $2\cdot\pi$, of a single fuel injector 160. In this illustration, zero leakage is assumed, in order to explain the basic strategy for calculating the fuel quantity. Just for illustration purposes, a raw pressure signal curve is shown as a dashed line, while a filtered pressure signal curve is shown as a solid curve. The calculation of the injected fuel quantity is conducted under using the filtered curve. FIG. 4 additionally shows the derivative of the fuel quantity Q over the crankshaft angle $\theta$.

The fuel quantity is a function depending on a pressure difference between a first sample during the injection (sample A) and a second sample after the injection (sample B): $Q_{inlet}=f(\Delta p_{inj})$. Since in this example leakage effects are non-existent, the total pressure difference between these samples are the determining factor for the injection. Therefore, the total pressure difference is equal to the injection pressure difference.

In the pressure graph of FIG. 4, the injection pressure difference $\Delta p_{inj}$ is marked as a difference between $p_A$, i.e. the pressure at a first sample, and $p_B$, i.e. the pressure at a second instance. In a lower part of FIG. 4, the resulting fuel flow is shown. During the fuel injection, the pressure has a higher value ($p_A$) than after the injection is accomplished ($p_B$), wherein, due to the assumed lack of leakages, the pressure $p_B$ remains constant. The ECU 450 controls the respective fuel injector 160 and injects fuel into the associated combustion chamber, driven by the fuel rail pressure. As stated before, the fuel quantity can be calculated by consideration of the flow resistance and other flow determining parameters between the fuel rail 170 and the combustion chamber 150 over the respective fuel injector 160, the pressure on the fuel rail 170 as well as the energizing time (ET). Consequently, the fuel quantity injected into the respective combustion chamber 150 can be calculated by using just two pressure values over the injection process. The fuel quantity follows to $Q_{inlet}=f(\Delta p_{inj})$. The curve of the quantity derivative, i.e. the fuel flow, is exemplarily chosen as a rectangular function, and the area under the rectangular curve represents the fuel quantity at the inlet of the respective injector, which is the sum of the quantity effectively injected into the respective combustion chamber and any dynamic leakages only occurring during the injection. These dynamic leakage effects may be considered fixed for the respective injector. Hence, the equation further above shall be adapted to already take this into account.

Figure 5:
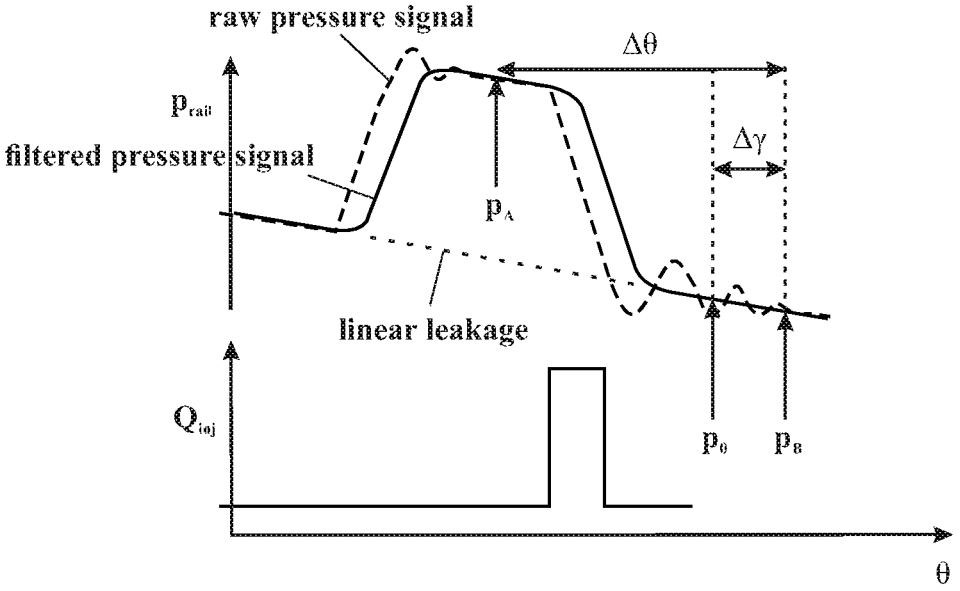
FIG. 5 shows pressure and fuel flow graphs with leakage.

However, if leakages occur, the pressure of the fuel rail 170 not only depends on performed fuel injections, but also on a leakage flow, be it caused by a pressure regulator, fuel injectors 160 or other components. FIG. 5 demonstrates that the leakage may have a linear effect on the pressure of the pressure rail 170, which is indicated by a dashed line having a constant slope. In other words, the measured pressure on the pressure rail 170 substantially constantly decreases irrespective of the injection process. A strategy of the method presented in this disclosure is to determine the slope of this linear pressure component, i.e. the pressure deviation per time, to isolate the leakage induced pressure drop.

Besides other techniques, a third sample is acquired not too far away from the second sample, i.e. in an angular region of the crankshaft where the injection has already ended, and to measure the pressure $p_0$ at this sample. From the pressure difference $p_0-p_B$ the slope of the leakage induced pressure curve can be obtained in this angular region of the crankshaft, which is referred to as $\Delta\gamma$. By extrapolation of the linear pressure drop over the angular region of interest, i.e. $\Delta\theta$, the leakage induced pressure drop can be calculated for the whole fuel injection process. Hence, the relevant injection pressure difference, as stated above, may be calculated by the formula $\Delta p_{inj}=(p_A-p_B)-\Delta p_{leak}$, which results in $\Delta p_{inj}=(p_A-p_B)-(p_0-p_B)*\Delta\theta/\Delta\gamma$. Again, the fuel quantity follows to $Q_{inlet}=f(\Delta p_{inj})$. Consequently, $\Delta p_{inj}$ and $\Delta p_{leak}$ may easily be discerned and monitored.

If the method described in this disclosure is applied to an internal combustion engine 110 that does not show leakage induced pressure drops, the extrapolation of the pressure difference between the third and the second sample will lead to extrapolating substantially zero onto the sampled pressure signals. Hence, the method is generally applicable to an internal combustion engine with and without leakage conditions.

The term sample, in the context of first sample, second sample and third sample, is intended to indicate a data reading from a signal sequence (e.g., pressure signal sequences) at a particular moment or instant in time. Although the terms first, second and third may be used herein to describe various samples in the crankshaft angle, these should not be limited by these terms. These terms may be only used to distinguish one sample from another sample. Terms such as "first," "second," and other numerical terms when used herein do not imply a sequence or order unless clearly indicated by the context. Thus, a first sample could be termed a second sample without departing from the teachings of the example embodiments. In particular, the second sample and the third sample do not need to have this order in the crankshaft angular domain, since the leakage induced pressure drop may also be calculated if the third sample follows after the second sample or if the third sample is before the second sample.

The method steps, processes, and operations described herein are not to be construed as necessarily requiring their performance in the particular order discussed or illustrated, unless specifically identified as an order of performance. It is also to be understood that additional or alternative steps may be employed.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method of operating an internal combustion engine having a fuel rail in fluid communication with a fuel pump and a fuel injector, the method comprising:

operating the fuel injector to perform a fuel injection;

sampling a sequence of pressure signals representative of a fuel pressure within the fuel rail during the fuel injection in a crankshaft angular domain;

filtering the sequence of pressure signals to reduce signal noise;

acquiring a first sample of the filtered pressure signals after a top dead center of the fuel pump and before the fuel injection has started in an injection interval;

acquiring a second sample of the filtered pressure signals after the injection and before a next pumping stroke;

calculating a total pressure difference between the first sample and the second sample;

determining a linear pressure slope at least at the second sample and calculating a leakage pressure difference between the first sample and the second sample based on the linear pressure slope;

calculating an injection pressure difference as the difference between total pressure difference and the leakage pressure difference;

calculating a value of a fuel quantity injected by the fuel injection as a function of the calculated value of the injection pressure difference; and sending a fuel injection command to the fuel injector based on the value of a fuel quantity calculated.

2. The method of claim 1, further comprising:

acquiring a third sample of the filtered pressure signals after the injection and before a next pumping stroke, wherein the second sample and the third sample are spaced apart from each other;

wherein determining the linear pressure slope includes calculating a pressure difference between the second sample and the third sample and dividing it by the crankshaft angle difference between the second sample and the third sample.

3. The method of claim 2, wherein the second sample and the third sample are spaced apart about at least $0.05\cdot\pi$ of the crankshaft angle.

4. The method of claim 2, wherein the second sample and the third sample are spaced apart in a range between $0.1\cdot\pi$ and $0.2\cdot\pi$ of the crankshaft angle.

5. The method of claim 1, wherein calculating the leakage pressure difference includes multiplying the linear pressure slope at the second sample by the angle difference between the first sample and the second sample.

6. The method of claim 1, wherein filtering the sequence of pressure signals includes using a SINC filter.

7. The method of claim 6, wherein the SINC filter is tuned on a rail wave pressure dominant frequency.

8. A fuel injection system comprising:

a fuel pump in fluid communication with a fuel injector through a fuel rail; and an electronic control unit configured to:

operate the fuel injector to perform a fuel injection;

sample a sequence of pressure signals representative of a fuel pressure within the fuel rail during the fuel injection in a crankshaft angular domain;

filter the sequence of pressure signals so as to reduce signal noise;

acquire a first sample after a top dead center of the fuel pump and before the fuel injection has started in an injection interval;

acquire a second sample after the injection and before a next pumping stroke;

calculate a total pressure difference between the first sample and the second sample;

determine a linear pressure slope at least at the second sample and calculate a leakage pressure difference between the first sample and the second sample based on the linear pressure slope;

calculate an injection pressure difference as the difference between the total pressure difference and the leakage pressure difference;

calculate a value of a fuel quantity injected by the fuel injection as a function of the calculated value of the injection pressure difference; and send a fuel injection command to the fuel injector based on the value of a fuel quantity calculated.

9. The fuel injection system of claim 8, further comprising:

choosing a third sample after the injection and before a next pumping stroke, wherein the second sample and the third sample are spaced apart from each other;

wherein determining the linear pressure slope includes calculating a pressure difference between the second sample and the third sample and dividing it by the crankshaft angle difference between the second sample and the third sample.

10. The fuel injection system of claim 9, wherein the second sample and the third sample are spaced apart about at least $0.05\cdot\pi$ of the crankshaft angle.

11. The fuel injection system of claim 10, wherein the second sample and the third sample are spaced apart in a range between $0.1\cdot\pi$ and $0.2\cdot\pi$ of the crankshaft angle.

12. The fuel injection system of claim 8, wherein calculating the leakage pressure difference includes multiplying the linear pressure slope at the second sample by the angle difference between the first sample and the second sample.

13. The fuel injection system of claim 8, wherein filtering the sequence of pressure signals includes using a SINC filter.

14. The fuel injection system of claim 13, wherein the SINC filter is tuned on a rail wave pressure dominant frequency.

15. An internal combustion engine comprising:

an engine block having a cylinder with a piston disposed therein and a cylinder head cooperating with the piston to define a combustion chamber;

a fuel pump configured to supply pressurized fuel to a fuel rail;

a fuel injector in fluid communication with the fuel rail and configured to inject fuel into the combustion chamber; and an electronic control unit configured to:

operate the fuel injector to perform a fuel injection;

sample a sequence of pressure signals representative of a fuel pressure within the fuel rail during the fuel injection in a crankshaft angular domain;

filter the sequence of pressure signals so as to reduce signal noise;

in an injection interval determine a first sample after a top dead center of the fuel pump and before the fuel injection has started;

acquire a second sample after the injection and before a next pumping stroke;

calculate a total pressure difference between the first sample and the second sample;

determine a linear pressure slope at least at the second sample and calculate a leakage pressure difference between the first sample and the second sample based on the linear pressure slope;

calculate an injection pressure difference as the difference between the total pressure difference and the leakage pressure difference;

calculate a value of a fuel quantity injected by the fuel injection as a function of the calculated value of the injection pressure difference; and send a fuel injection command to the fuel injector based on the value of a fuel quantity calculated.

* * * * *